US009487946B2

(12) United States Patent
Bengtsson

(10) Patent No.: US 9,487,946 B2
(45) Date of Patent: Nov. 8, 2016

(54) POST

(71) Applicant: Bröderna Bengtssons Dumpertransport AB, Kolsva (SE)

(72) Inventor: Per-Erik Bengtsson, Kolsva (SE)

(73) Assignee: Bröderna Bengtssons Dumpertransport AB, Kolsva (SE)

( * ) Notice: Subject to any disclaimer, the term of this patent is extended or adjusted under 35 U.S.C. 154(b) by 0 days.

(21) Appl. No.: 14/777,970

(22) PCT Filed: Feb. 25, 2014

(86) PCT No.: PCT/EP2014/053649

§ 371 (c)(1),
(2) Date: Sep. 17, 2015

(87) PCT Pub. No.: WO2014/146872

PCT Pub. Date: Sep. 25, 2014

(65) Prior Publication Data

US 2016/0281306 A1 Sep. 29, 2016

(30) Foreign Application Priority Data

Mar. 22, 2013 (SE) ..... 1350369

(51) Int. Cl.
*E04B 1/41* (2006.01)
*E04C 3/20* (2006.01)
*E04H 17/20* (2006.01)

(52) U.S. Cl.
CPC ..... *E04B 1/4171* (2013.01); *E04C 3/20* (2013.01); *E04H 17/20* (2013.01)

(58) Field of Classification Search
CPC ..... E04C 3/20; E04H 17/20; E04H 17/24; E04B 1/41; E04B 1/4171; E01F 9/658; E01F 9/673
USPC ..... 52/367, 372, 375, 600, 309.7, 309.16
See application file for complete search history.

(56) References Cited

U.S. PATENT DOCUMENTS

| | | | | |
|---|---|---|---|---|
| 1,187,600 | A | 6/1916 | Basham | |
| 1,356,514 | A * | 10/1920 | Buckner | E04H 17/20 256/49 |
| 1,481,274 | A * | 1/1924 | Rothrock | E04B 1/4171 52/105 |
| 1,501,665 | A | 7/1924 | James | |
| 1,568,352 | A | 1/1926 | Toennes | |
| 1,649,909 | A * | 11/1927 | McKeon | E04H 17/06 256/19 |
| 1,905,603 | A * | 4/1933 | Place | E04B 1/4171 16/16 |
| 2,040,350 | A * | 5/1936 | Wernette | E04B 5/04 52/375 |

(Continued)

FOREIGN PATENT DOCUMENTS

| | | |
|---|---|---|
| DE | 29 04 907 A1 | 8/1980 |
| GB | 215 681 A | 5/1924 |

(Continued)

*Primary Examiner* — Robert Canfield
(74) *Attorney, Agent, or Firm* — Dilworth & Barrese, LLP

(57) ABSTRACT

The present invention relates to a post (12) made of a first material (2) comprising an element (13) made of a second material that is softer than the first material. The element is partially embedded in the first material and has a front surface (6) that forms part of the surface of the post. The element comprises in a cross section perpendicular to the longitudinal axis of the post a front portion (8') including the front surface and a rear portion (9'). The element is designed so that a waist (w1, w2) is formed between the front and rear portions. The front portion is tapering towards the waist and at least a part of the rear portion has a width larger than the width of the waist.

8 Claims, 2 Drawing Sheets

(56) References Cited

U.S. PATENT DOCUMENTS

| | | | | |
|---|---|---|---|---|
| 2,049,907 | A * | 8/1936 | Hess | E04C 1/39 52/351 |
| 2,318,692 | A * | 5/1943 | Johnson | E04B 1/41 249/115 |
| 3,528,209 | A * | 9/1970 | Schillinger | B28B 23/024 52/223.8 |
| 4,478,021 | A * | 10/1984 | Person | B28B 15/00 52/309.7 |
| 4,548,009 | A * | 10/1985 | Dahowski | E01C 11/106 404/48 |
| 4,824,077 | A | 4/1989 | Brickner | |
| 8,955,287 | B2 * | 2/2015 | Fortney | E01C 11/106 52/396.04 |
| 2008/0115440 | A1 * | 5/2008 | Fortney | E01C 11/106 52/393 |

FOREIGN PATENT DOCUMENTS

| | | | |
|---|---|---|---|
| GB | 241 440 | A | 10/1925 |
| GB | 426 003 | A | 3/1935 |
| GB | 560 070 | A | 3/1944 |
| SE | 415 378 | B | 9/1980 |

* cited by examiner

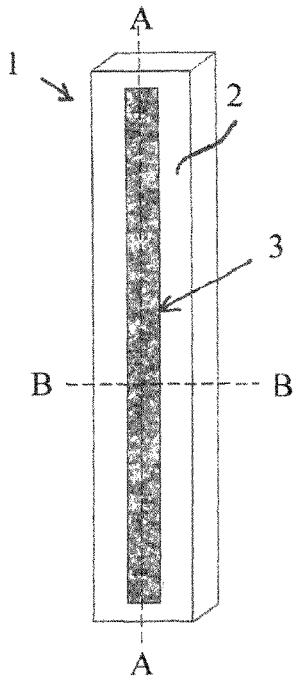
Fig 1
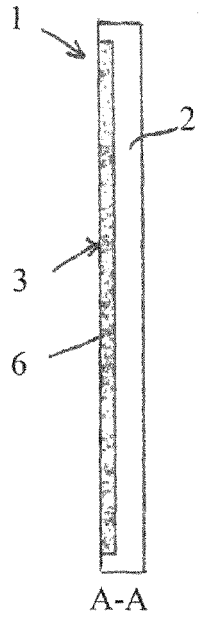
Fig 2
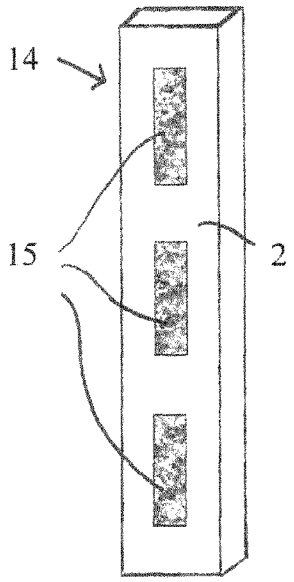
Fig 6
Fig 7
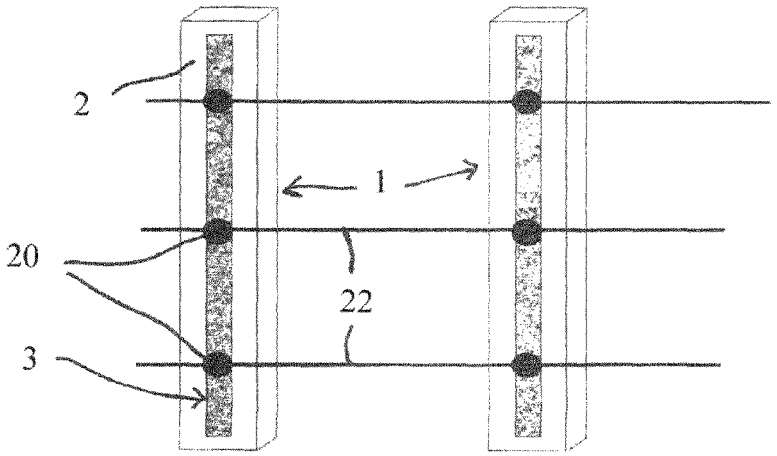

POST

FIELD OF THE INVENTION

The present invention relates to posts for holding one or more objects, such as wires, fences, or signs.

PRIOR ART

Posts can be made of various materials such as wood, metal or concrete. Posts made of wood have the disadvantage that they are quickly destroyed by the elements. They are also attractive for animals to gnaw on. This is particularly a problem when they are used for fencing horse paddocks.

Posts made of concrete have the advantage that they are very durable, and resistant against ageing and weathering. A disadvantage of posts made of concrete is that it is difficult to screw in the concrete due to the fact that concrete is a hard material. This is particular a problem when the post is to be used for holding objects, such as wires, fences, or signs, and it is necessary to attach fastening for the objects to the post.

A solution to this problem is to mold a piece of wood into the concrete when the post is manufactured, as disclosed in GB560070 and GB426003. A problem with this solution is that when the concrete has set, the wood dries and shrinks and thus becomes loose in the concrete so that it may fall out. To prevent the wood strip from falling out of the concrete, it has been proposed to make the strip of greater width at the back than at the front. However, a disadvantage with this solution is that the piece of wood, which is softer than the concrete, will constitute a large part of the post, which leads to reduced strength of the post.

It is particularly important that the piece of wood is properly secured to the concrete when the post is used for holding objects, such as wires, and fences, to avoid that the piece of wood is detached from the post and the objects held by the post falls down. GB426003 proposes a solution to the problem by using plugs through the piece of wood. However, the plugs make the manufacture of the post more complicated, and thus more costly.

OBJECT AND SUMMARY OF THE INVENTION

It is an object of the present invention to provide an improved post, which at least partly overcome the above mentioned deficiencies of the prior art posts The post is made of a first material comprising an element made of a second material that is softer than the first material and partially embedded in the first material, and the element has a front surface that forms part of an exterior surface of the post. The element comprises a front portion including the front surface and a rear portion, and the element is designed so that a waist is formed between the front and rear parts in a cross section perpendicular to the longitudinal axis of the post, the front portion is tapering towards the waist and at least a part of the rear portion has a width larger than the width of the waist. The width of the waist is less than the width of the front surface.

According to the invention the element comprises two parts separated by a waist. The rear portion and the waist are embedded in the first material. Due to the waist and the fact that the element is embedded in the harder and more durable first material, the element is kept in place in the post, although the element is subjected to stresses, for example, in the form of tensile forces. The element is kept in place by the surrounding first material. Due to the fact that at least a part of the rear portion has a width larger than the width of the waist, the rear portion forms an anchor and retains the element in the post even though the element is subjected to a tensile force. Thus, no additional fastening devices, such as plugs or anchoring devices is needed for keeping the element in place. Accordingly, manufacturing of the post is facilitated and the material costs for the post is reduced.

Due to the fact that the outer portion is tapered towards the inner part, the ration between the area of the element and the total area of the post can be reduced compared to an element having a rectangular cross section, thereby the strength of the post is increased.

With the term post is meant an elongated piece suitable for holding objects. The term post also covers piles, pillar, poles and the like.

The invention provides a durable and yet flexible post that allows to set up different types of objects regardless of the shape of the object, which is easy to manufacture, inexpensive and has a high strength and durability.

The first material is preferably a hard material, such as concrete, which is inexpensive, durable and weatherproof. The elongate element is made of a softer material appropriate to screw in, such as wood, hard rubber, plastic, or a plastic composite. The invention makes it possible to manufacture the post in a cheap, durable and weather resistant material, while allowing attachment of various types of fastenings to the post by screwing fastenings directly in the element in the post. Due to the fact that the element is partially embedded in the second material, the element is protected from being destroyed by bad weather, and animals are prevented from gnawing on the element.

In one embodiment of the invention, the second material is wood-plastic composite (WPC). WPC has a longer endurance than wood and it does not shrink when it dries. Thus, the life of the post will be prolonged and the element will not become loose in the concrete after drying of the post.

Preferably, the element is cast into the first material. Such a post is simple and inexpensive to manufacture.

In one embodiment of the invention, the rear portion protrudes from the waist to form a shoulder on each side of the waist in a cross section perpendicular to the longitudinal axis of the post, and the rear portion is tapering in a direction away from the waist. Due to the shoulders, the element is retained in the second material when the element is subjected to a tensile force. Due to the fact that the rear portion is tapering in a direction away from the waist, the ration between the area of the element and the total area of the post can be further reduced, thereby the strength of the post is increased.

In one embodiment of the invention, said front portion has a partially triangular shape in a cross section perpendicular to the longitudinal axis of the post, and the front surface forms part of the base of the triangle.

In one embodiment of the invention, said rear portion has a triangular shape in a cross section perpendicular to the longitudinal axis of the post, arranged with the base of the triangle adjacent to the waist.

In one embodiment of the invention, the rear portion has a rear surface facing the second material, and the element has a greater width at the front surface than at the rear surface in a cross section perpendicular to the longitudinal axis of the post.

In one embodiment of the invention, the element is elongated and arranged in such way that it extends parallel to the longitudinal axis of the post. Preferably, the length of the element is at least 0.2 m, preferably at least 0.5 m, and most preferably at least 0.8 m. Due to the fact that the element is extending along a portion of the side surface, it is optional to choose where on the post the fastenings are attached and how many fastenings to be set up. This embodiment of invention enables a number of fasteners to be screwed into the element at different distances from the end of the post.

In one embodiment of the invention, the element extends along a main part of the length of the post. This embodiment gives multiple options where the fastenings can be fastened along the side surface of the post.

BRIEF DESCRIPTION OF THE DRAWINGS

The invention will now be explained more closely by the description of different embodiments of the invention and with reference to the appended figures.

FIG. 1 shows a perspective view of a post according to a first embodiment of the invention.

FIG. 2 shows the post of FIG. 1 in a section A-A through the post.

FIG. 6 shows a perspective view of a post according to a fourth embodiment of the invention.

FIG. 7 shows an example of use of the post shown in FIG. 1.

DETAILED DESCRIPTION OF PREFERRED EMBODIMENTS OF THE INVENTION

Figure 3:
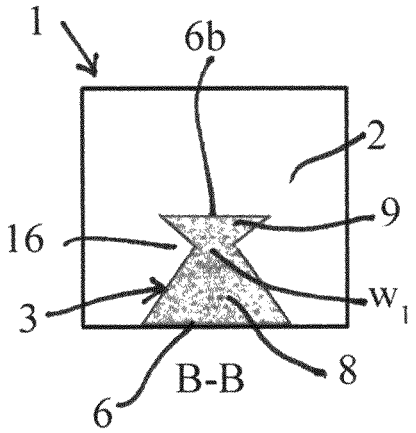
FIG. 3 shows the post of FIG. 1 in a section B-B through the post.

FIG. 1 shows a perspective view of a post 1 according to a first embodiment of the invention. FIG. 2 shows the post 1 in a section A-A along the longitudinal axis of the post, and FIG. 3 shows the post 1 in a section B-B across the longitudinal axis of the post. In this embodiment, the post has a rectangular cross-sectional shape. In alternative embodiments, the post may have other shapes, such as a circular or triangular cross section.

The post 1 is made of a first material 2 that is hard and includes an elongated element 3 made of a second material that is softer than the first material and allows a screw to be screwed into the element. In this example, the second material 2 is concrete and the element 3 is partially embedded in the concrete. The concrete can be reinforced, for example, fiber-reinforced concrete or XL concrete. The second material is, for example, pressure-creosoted wood, hard rubber, plastic, plastic composite, or wood-plastic composite. Wood-plastic composites (WPCs) are composite materials made of wood fiber or wood flour, and thermoplastics, such as PE, PP, or PVC. WPC is particularly suitable in this application due to its long life and durability to impact from the weather.

The element 3 is elongated and arranged to extend parallel to the longitudinal axis of the post. In the first embodiment of the invention shown in FIG. 1, the element extends along the main part of the length of the post. The element 3 has a length which is preferably at least 0.5 m, and most preferably at least 0.8 m. The element 3 ends at a distance from both ends of the post. The first material encloses three sides of the element, but not one longitudinal side 6 of the element. The element 3 extends from the longitudinal side 6 inwardly toward a centerline the post, but ends at a distance from the center line. The post should contain as much concrete as possible to have good solidity.

The element 3 is partially embedded in the first material 2. Preferably the element is entirely embedded in the first material, except for one side that forms part of the exterior surface of the post. In this embodiment, five sides of the element are embedded in the first material. However, a sixth side of the element is not embedded in the first material. The sixth side of the element has a front surface 6 facing the surroundings. The front surface 6 forms part of an exterior surface of the post, thereby allowing attachment of one or more fasteners to the post, for example by screws. The front surface 6 is preferably flat and disposed flush with the surface of the first material so that the post will have a smooth surface.

The element 3 includes an elongated body that extends along the longitudinal axis of the post. Preferably, the cross-section of the element is the same along the entire length of the element. As seen from FIG. 3, the body of the element 3 comprises a front portion 8 including the front surface 6 and a rear portion 9. The body is designed so that a waist $w_1$ is formed between the front and rear portions 8, 9 in a cross section perpendicular to the longitudinal axis of the post. Due to the waist, an elongated recess or groove 16 is formed on each side of the element 3 along a longitudinal axis of the element, and accordingly in parallel with the longitudinal axis of the post. The grooves are embedded in the first material. Due to the recesses caused by the waist, and the fact that the element is embedded in the harder and more durable first material, the element is kept in place in the post, although the element is subjected to stresses, for example, in the form of tensile forces.

The front portion 8 is tapering towards the waist. In this embodiment, the rear portion 9 is also tapering towards the wrist. The rear portion 9 has a rear surface 6*c* facing the second material 2 and the element 3 has a greater width at the front surface 6 than at the rear surface 6*b*. The rear portion 9, which is embedded in the first material 2, retains the element in the post. The rear portion 9 projects from the body in a direction perpendicular to an axis extending from the front surface 6 towards the center of the element in a plane perpendicular to the longitudinal direction of the post, thereby preventing the element from being removed from the second material and thereby from the post. The protruding inner part 9 has a cross section perpendicular to the longitudinal direction of the post, which is tapered in a direction towards waist 6 and the outer portion 8 is tapered towards the inner part so that the body gets a waist. The front portion 8 has a partially triangular shape, and the front surface forms the base of the triangle. The rear portion 9 has also a partially triangular shape and the rear surface 6*b* forms the base of the triangle.

Figure 4:
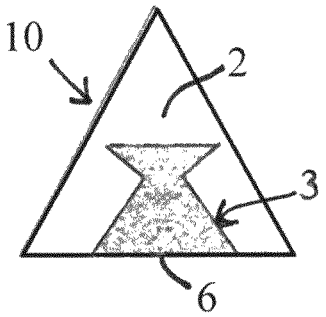
FIG. 4 shows a cross section through a post according to a second embodiment of the invention.

FIG. 4 shows a cross section through a post 10 according to a second embodiment of the invention, which has a triangular cross section. The element 3 is of the same type as in the first embodiment. One advantage of a post according to this embodiment is that it has a low weigh.

Figure 5:
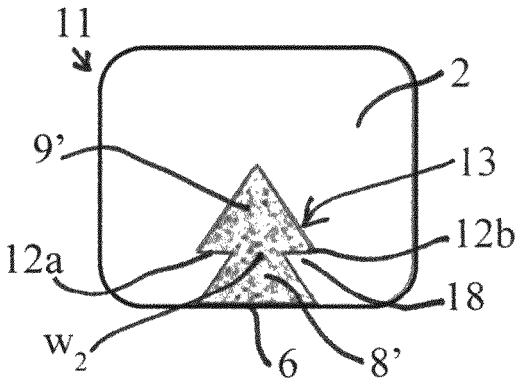
FIG. 5 shows a cross section through a post according to a third embodiment of the invention.

FIG. 5 shows a cross section through a post 11 according to a third embodiment of the invention. Preferably, the cross-section of the element is the same along the entire length of the element. In this embodiment, the post comprises an element 13 having a different cross sectional shape than the embodiment shown in FIGS. 3 and 4. The element has a body comprising a front portion 8' including the front surface 6 and a rear portion 9', and the body is designed so that a waist $w_2$ is formed between the front and rear portions 8',9' in a cross section perpendicular to the longitudinal axis of the post. Due to the waist, an elongated recess or groove 18 is formed on each side of the element 3 along a longitudinal axis of the element, and accordingly in parallel with the longitudinal axis of the post. The grooves are embedded in the first material.

The front portion 8' is tapering towards the waist $w_2$. The rear portion protrudes from the waist in a direction perpendicular to an axis extending from the front surface 6 towards the center of the element in a plane perpendicular to the longitudinal direction of the post, and by that form a shoulder 12*a-b* on each side of the waist. The shoulder 12*a-b* has a width larger than the width of the waist. The rear portion 9' is tapering from the shoulders 12*a-b* in a direction away from the waist and towards the center of the post. The front portion 8' has a partially triangular shape and the front surface forms the base of the triangle. The rear portion 9' has a triangular shape and is arranged with the base of the triangle adjacent to the waist and the narrow end of the triangle pointing away from the element.

The elements 3 and 13 can be used in combination with posts of other shapes, for example, a circular cross section.

FIG. 6 shows a perspective view of a post 14 according to a fourth embodiment of the invention. In this embodiment, the post contains a plurality of elongated elements 15 of the second material arranged above each other along the longitudinal axis of the post. The elements 15 preferably have a length of at least 0.2 m FIG. 7 shows an example of use of the post 1 for mounting a fence. A number of fasteners 20 to hold up wires 22 are screwed into the elements 3 of each of the posts and at different heights from the post ends. Wires 22 have been provided between the fasteners.

The present invention is not limited to the embodiments disclosed but can be varied and modified within the scope of the following claims. For example, the post may comprise several elements 3 arranged in parallel with the longitudinal axis of the post, and with their longitudinal sides facing different sides of the post so that it is possible to fasten the fastening devices at several sides of the post. The fasteners can be fastened in other ways than with screws. It is also possible to nail or rivet them in the element. In other embodiments, the post can have different shapes, for example a circular cross section.

The invention claimed is:

1. A post made of a first material and comprising a solid element made of a second material that is softer than the first material, wherein the element is partially embedded in the first material, the element has a front surface that forms part of an exterior surface of the post disposed flush with an exterior surface of the first material, the element comprises a front portion including the front surface and a rear portion, and the element is designed such that a waist is formed between the front and rear portions in a cross section perpendicular to the longitudinal axis of the post, the front portion tapers towards the waist, and at least a part of the rear portion has a width larger than the width of the waist.

2. The post according to claim 1, wherein the rear portion protrudes from the waist to form a shoulder on each side of the waist in a cross section perpendicular to the longitudinal axis of the post, and the rear portion tapers in a direction away from the waist.

3. The post according to claim 1, wherein said front portion has a partially triangular shape in a cross section perpendicular to the longitudinal axis of the post, and the front surface forms part of the base of the triangle.

4. The post according to claim 1, wherein said rear portion has a triangular shape in a cross section perpendicular to the longitudinal axis of the post, arranged with the base of the triangle adjacent to the waist.

5. The post according to claim 1, wherein the rear portion has a rear surface facing the second material, and the element has a greater width at the front surface than at the rear surface in a cross section perpendicular to the longitudinal axis of the post.

6. The post according to claim 1, wherein said first material is concrete and the element is partially embedded in the concrete.

7. The post according to claim 1, wherein said second material is wood-plastic composite.

8. The post according to claim 1, wherein the element extends along a main part of the length of the post.

* * * * *